US008063874B2

(12) United States Patent
Katayanagi et al.

(10) Patent No.: US 8,063,874 B2
(45) Date of Patent: Nov. 22, 2011

(54) ELECTRONIC APPARATUS

(75) Inventors: Masanori Katayanagi, Yamanashi (JP); Tomonori Sunazuka, Hino (JP); Kenji Ochiai, Koganei (JP)

(73) Assignee: Fujitsu Toshiba Mobile Communications Limited, Kawasaki (JP)

( * ) Notice: Subject to any disclaimer, the term of this patent is extended or adjusted under 35 U.S.C. 154(b) by 262 days.

(21) Appl. No.: 12/471,781

(22) Filed: May 26, 2009

(65) Prior Publication Data

US 2010/0194289 A1 Aug. 5, 2010

(30) Foreign Application Priority Data

Jan. 30, 2009 (JP) ..... P2009-020381

(51) Int. Cl.
*G09G 3/36* (2006.01)

(52) U.S. Cl. ..... 345/102; 345/207; 315/151; 315/291

(58) Field of Classification Search ..... 315/151, 315/291; 345/36, 102, 158, 589, 207
See application file for complete search history.

(56) References Cited

U.S. PATENT DOCUMENTS

| | | | | |
|---|---|---|---|---|
| 6,597,339 | B1 * | 7/2003 | Ogawa | 345/102 |
| 7,006,130 | B2 * | 2/2006 | Harshbarger et al. | 348/189 |
| 2006/0012543 | A1 * | 1/2006 | Ikeda et al. | 345/36 |
| 2007/0229447 | A1 * | 10/2007 | Takahara et al. | 345/102 |
| 2008/0224914 | A1 * | 9/2008 | Kawashima et al. | 341/158 |
| 2009/0122069 | A1 * | 5/2009 | Furusawa et al. | 345/589 |
| 2009/0184887 | A1 * | 7/2009 | Mizuno et al. | 345/1.1 |
| 2011/0181567 | A1 * | 7/2011 | Tanba et al. | 345/207 |

FOREIGN PATENT DOCUMENTS

| | | | |
|---|---|---|---|
| JP | 10-228010 | A | 8/1998 |
| JP | 2891955 | B2 | 2/1999 |
| JP | 2008-219659 | A | 9/2008 |

* cited by examiner

*Primary Examiner* — Douglas W Owens
*Assistant Examiner* — Thai Pham
(74) *Attorney, Agent, or Firm* — Maschoff Gilmore & Israelsen

(57) ABSTRACT

An electronic apparatus includes: a luminance adjustable display module; an illuminance sensor configured to detect illuminance around the electronic apparatus; and a controller configured to: read the illuminance from the illuminance sensor; determine luminance corresponding to the illuminance; control the luminance adjustable display module to set luminance to the determined luminance; and set a waiting time based on the determined luminance, the waiting time being a time to a next time point of illuminance reading and luminance control. The controller is configured to set the waiting time short when the determined luminance is high and to set the waiting time long when the determined luminance is low.

3 Claims, 4 Drawing Sheets

FIG. 2A

ILLUMINANCE/LUMINANCE TABLE 3

ILLUMINANCE 3a LUMINANCE 3b

| AMBIENT ILLUMINANCE | LUMINANCE OF DISPLAY MODULE | |
|---|---|---|
| ILLUMINANCE "HIGH" | LUMINANCE "HIGH" | HIGH POWER CONSUMPTION |
| ILLUMINANCE ··· | LUMINANCE ··· | |
| ILLUMINANCE ··· | LUMINANCE ··· | |
| ILLUMINANCE ··· | LUMINANCE ··· | |
| ILLUMINANCE "LOW" | LUMINANCE "LOW" | LOW POWER CONSUMPTION |

FIG. 2B

LUMINANCE/WAITING TIME TABLE 4

LUMINANCE 4a WAITING TIME 4b

| LUMINANCE OF DISPLAY MODULE | WAITING TIME OF LUMINANCE CONTROL (SEC) |
|---|---|
| LUMINANCE "HIGH" (HIGH POWER CONSUMPTION) | 1 |
| LUMINANCE ··· | 1.5 |
| LUMINANCE ··· | 2 |
| LUMINANCE ··· | 2.5 |
| LUMINANCE "LOW" (LOW POWER CONSUMPTION) | 3 |

ELECTRONIC APPARATUS

CROSS-REFERENCE TO RELATED APPLICATIONS

The entire disclosure of Japanese Patent Application No. 2009-020381 filed on Jan. 30, 2009, including specification, claims, drawings and abstract is incorporated herein by reference in its entirety.

BACKGROUND

1. Field of the Invention

One aspect of the invention relates to an electronic apparatus configured to adjust the luminance of the display screen according to the illuminance therearound.

2. Description of the Related Art

In electronic apparatus such as cell phones and cameras, to make the display screen easy to see, the light-emission luminance of the display screen is controlled so as to have an optimum value for the ambient illuminance. In this connection, there is an apparatus that is reduced in power consumption (see JP-A-2008-219659 (paragraphs 0029 and 0031 and FIGS. 7 and 8), for instance). In JP-A-2008-219659 (FIG. 7 and paragraph 0029), the battery operation time is elongated by reducing the power consumption by making the luminance of a backlight of a display module lower when the residual energy of a battery is small than when the residual energy is large. Furthermore, in JP-A-2008-219659 (FIG. 8 and paragraph 0031), during daytime when there is a large difference between illuminance in the sun and that in the shade, that is, a rapid variation occurs in ambient illuminance, a luminance control is employed in which the luminance control cycle is shortened to quickly respond to a rapid luminance variation.

There is another apparatus that is reduced in power consumption (see JP No. 2,891,955 (Pages 1-3 and FIGS. 1 and 2), for instance). In JP No. 2,891,955, the average power consumption of a processor etc. for calculating optimum luminance is reduced by turning on the power to the processor etc. intermittently rather than all the time using a timer. Same as in JP-A-2008-219659, the control can follow an illuminance variation by a variable setting of the timer cycle that the timer cycle is set long in an environment with a small illuminance variation and short in an environment with a large illuminance variation (JP No. 2,891,955, paragraph 0015).

The apparatus of JP-A-2008-219659 can elongate the battery operation time by reducing the power consumption by lowing the luminance of the backlight of the display module when the battery residual energy is small. However, a problem may arise that during such a control the display screen is reduced in luminance and hence made difficult to see.

In the apparatus of JP No. 2,891,955, the power consumption of the processor etc. for calculating optimum luminance is reduced. However, the power used for the light emission of the display module is much larger than that consumed by the processor etc. For example, where the display module is an LCD or the like, very large power is consumed for the light emission of the backlight. In the case of organic LEDs or the like, very large power is supplied for the light emission of the organic LEDs.

SUMMARY

According to an aspect of the invention, there is provided an electronic apparatus including: a luminance adjustable display module; an illuminance sensor configured to detect illuminance around the electronic apparatus; and a controller configured to: read the illuminance from the illuminance sensor; determine luminance corresponding to the illuminance; control the luminance adjustable display module to set luminance to the determined luminance; and set a waiting time based on the determined luminance, the waiting time being a time to a next time point of illuminance reading and luminance control, wherein the controller is configured to set the waiting time short when the determined luminance is high and to set the waiting time long when the determined luminance is low.

BRIEF DESCRIPTION OF THE DRAWINGS

Embodiment may be described in detail with reference to the accompanying drawings, in which:

FIG. 2A shows an exemplary illuminance/luminance table 3 of the electronic apparatus 100 according to the embodiment of the invention;

FIG. 2B shows an exemplary luminance/waiting time table 4 of the electronic apparatus 100 according to the embodiment of the invention;

DETAILED DESCRIPTION OF THE EMBODIMENTS

Figure 1:
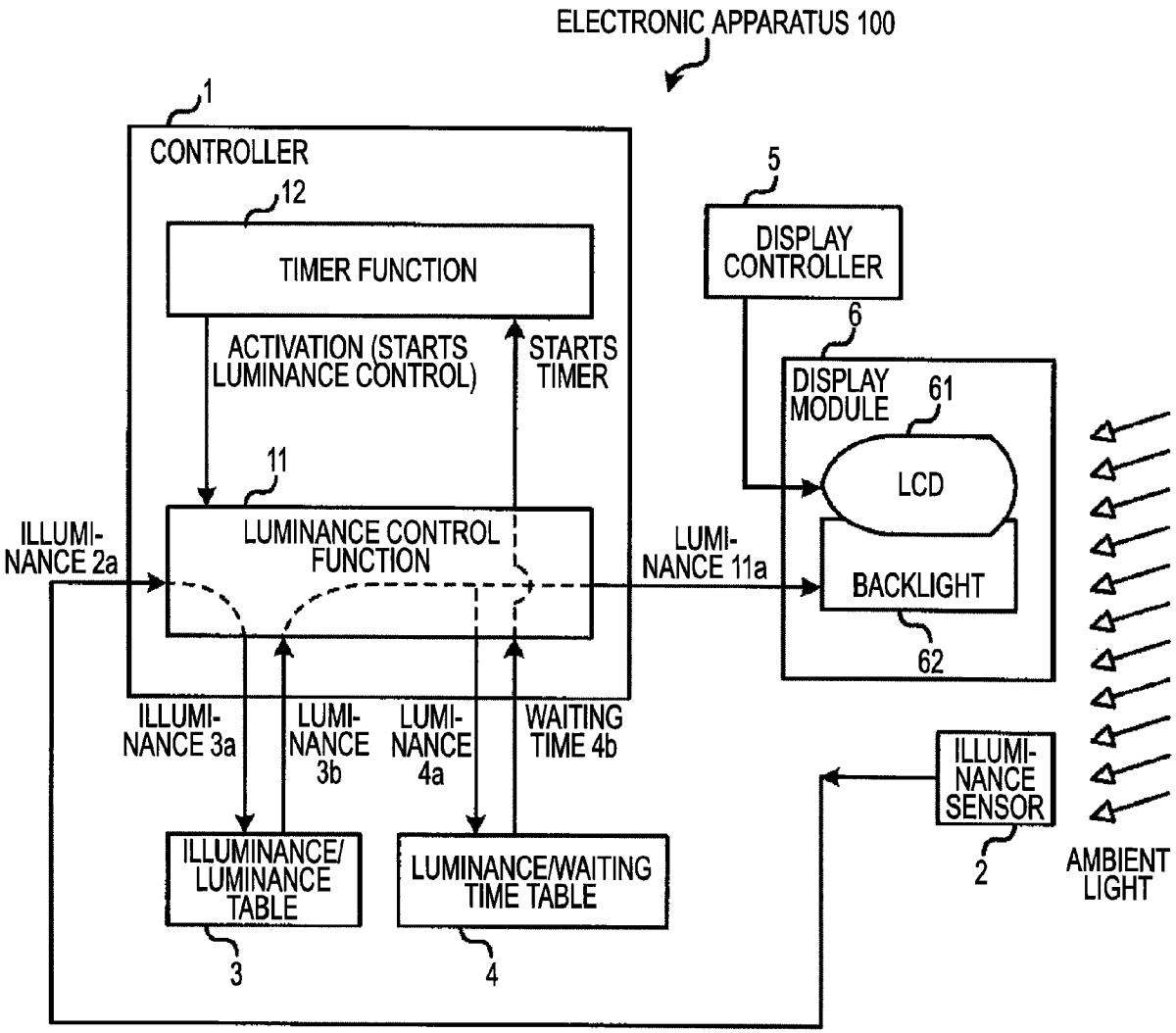
FIG. 1 is an exemplary block diagram of an electronic apparatus 100 according to an embodiment of the present invention.

FIG. 1 is a block diagram of an electronic apparatus 100 according to an embodiment of the present invention. FIGS. 2A and 2B show an illuminance/luminance table 3 and a luminance/waiting time table 4 of the electronic apparatus 100 according to the embodiment of the invention. The configuration etc. will be described below with reference to both figures.

The electronic apparatus 100 is configured of a controller 1, an illuminance sensor 2, the illuminance/luminance table 3, the luminance/waiting time table 4, a display controller 5, a display module 6, etc.

Disposed in a vicinity of the display module 6, the illuminance sensor 2 measures ambient-light illuminance of the display module 6 and supplies an illuminance 2*a* signal to the controller 1.

The illuminance/luminance table 3 (see FIG. 2A) is a table in which optimum light-emission luminance values (luminance 3*b* outputs) of the display module 6 are recorded in advance for respective ambient illuminance values (illuminance 3*a* inputs). The luminance 3*b* output is data corresponding to power to be supplied to a backlight 62 of the display module 6, that is, light-emission luminance of the backlight 62. When the illuminance 3*a* is high (bright), the viewability is rendered low if the degree of light emission of the display module 6 is low (dark) and hence the luminance 3*b* is set high (bright) to increase the viewability. Therefore, the power consumption of the display module 6 is also made high. When the illuminance 3*a* is low (dark), sufficient viewability is secured even if the luminance 3*b* is set low. Therefore, the luminance 3*b* is set low and the power consumption of the display module 6 is also made low.

The luminance/waiting time table 4 is a table in which waiting times (waiting time 4*b* outputs) to a start of processing of a luminance control function 11 are recorded in advance for respective light-emission luminance values (luminance 4*a* inputs) of the display module 6, that is, power consumption values. The waiting time is set short (e.g., 1 sec) when the luminance 4*a* input is large (the power consumption is high), and is set long (e.g., 3 sec) when the luminance 4*a* input is small (the power consumption is low). That is, the waiting time is applied weighing so as to vary reversely to the manner of variation of the luminance 4*a* (power consumption).

In the display controller 5, which is a display controller for the display module 6, controls display data according to the form of the display module 6 and outputs resulting display data to an LCD 61.

The display module 6, which is an LCD module, is configured of the LCD 61, the backlight 62, etc. The current flowing through the backlight 62 is varied according to a luminance 11*a* signal that is output from the luminance control function 11, whereby the light-emission luminance of the backlight 62, that is, the light-emission luminance of the display module 6, is varied.

The controller 1, which is configured of a CPU, a RAM, a ROM, etc., performs the luminance control function 11, a timer function 12, etc. by running programs stored in the ROM.

Broken lines in the block of the luminance control function 11 indicate input/output relationships between pieces of information that are controlled by the luminance control function 11. The luminance control function 11 reads an illuminance 2*a* signal representing ambient illuminance measured by the illuminance sensor 2, gives it to the illuminance/luminance table 3 as an illuminance 3*a* input and reads out a corresponding luminance 3*b*, and supplies it to the backlight 62 as a luminance 11*a* signal representing determined luminance. The backlight 62 emits light at this luminance. The processing so far described is conventional processing.

Then, the luminance control function 11 gives the thus-determined luminance 3*b* to the luminance/waiting time table 4 as a luminance 4*a* input and reads out a corresponding waiting time 4*b*, sets it in the timer of the timer function 12, and suspends the processing of the luminance control function 11 itself.

After a lapse of the waiting time 4*b*, the luminance control function 11 is activated again by the timer function 12. The above processing is repeated thereafter.

As described in describing the luminance/waiting time table 4 (see FIG. 2B), the waiting times 4*b* are set so as to vary reversely to the manner of variation of the luminance 4*a* (power consumption). An advantage of this setting will be described later with reference to FIG. 4.

Figure 3:
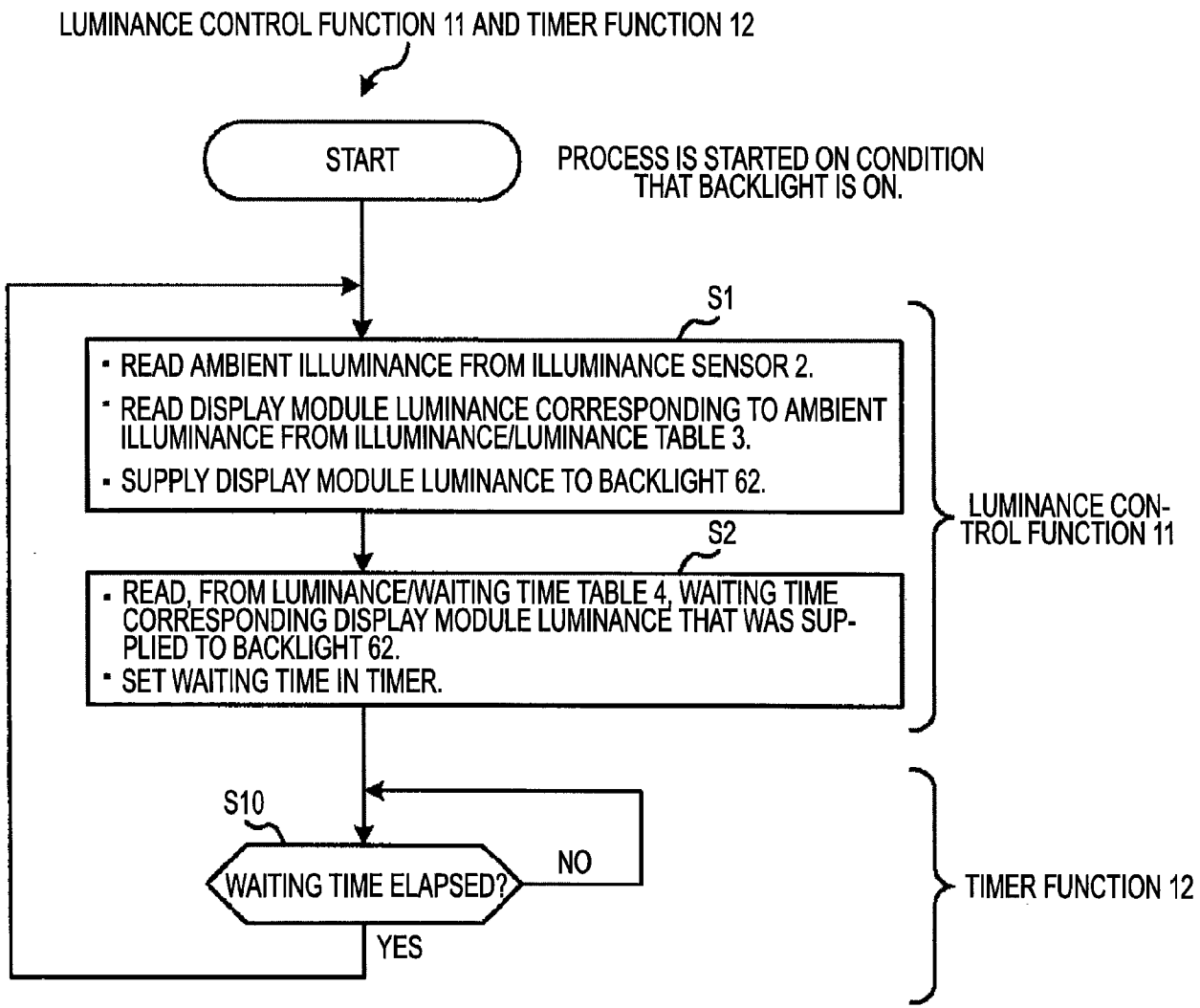
FIG. 3 is an exemplary operation flowchart of a luminance control function 11 and a timer function 12 of a controller 1 of the electronic apparatus 100 according to the embodiment of the invention.

FIG. 3 is an operation flowchart of the luminance control function 11 and the timer function 12 of the controller 1 of the electronic apparatus 100 according to the embodiment of the invention.

When a state for display on the display module 6 is established by, for example, opening the body of the electronic apparatus 100, the luminance control function 11 and the timer function 12 start to operate.

First, at step S1, the luminance control function 11 reads an illuminance 2*a* signal representing ambient illuminance from the illuminance sensor 2 and reads a corresponding display module luminance 3*b* from the illuminance/luminance table 3 using the illuminance 2*a* signal as an illuminance 3*a* input, and supplies the luminance 3*b* to the backlight 62 as a luminance 11*a* signal. As a result, the light-emission luminance of the display module 6 is made high if the ambient illuminance is high and is made low if the ambient illuminance is low. The display module 6 is thus kept easy to see according to the ambient illuminance. The power consumption is high if the light-emission luminance of the display module 6 is high and is low if the light-emission luminance of the display module 6 is low. Step S1 is a conventional step.

At step S2, the luminance control function 11 reads a corresponding waiting time 4*b* from the luminance/waiting time table 4 using, as a luminance 4*a* input, the luminance 11*a* (equals to luminance 3*b*) that was supplied to the backlight 62, and sets the waiting time 4*b* in the timer of the timer function 12. Then, the luminance control function 11 finishes its processing.

Then, the process goes to the part of which the timer function 12 is in charge. At step S10, the timer function 12 starts to count to the waiting time 4*b* which was set at step S2. When the waiting time 4*b* has elapsed, the process returns to the part of which the luminance control function 11 is in charge and the luminance control function 11 performs step S1 again.

With the above process, the cycle of the luminance control function 11 is equal to (waiting time 4*b*)+(processing time of steps S1 and S2). Since the waiting time 4*b* in on the order of seconds, the cycle is approximately equal to the waiting time 4*b*.

As described above, step S1 which is performed by the luminance control function 11 to control the light-emission luminance of the display module 6 by determining light-emission luminance suitable for ambient illuminance is performed only after a lapse of a waiting time 4*b*. Therefore, if the ambient illuminance varies while the timer is counting to a waiting time 4*b*, execution of light-emission luminance optimization process for resulting ambient illuminance is not started until the waiting time 4*b* elapses. In addition, the waiting time 4*b* is set at step S2 from the waiting times that vary reversely to the manner of variation of the luminance 3*b* (power consumption) to be determined and output by the luminance control function 11.

The above operation flowchart is such that the part of which the luminance control function 11 is in charge and the part of which the timer function 12 is in charge are executed in succession. Alternatively, the luminance control function 11 may be provided as a separate function and activated by an interruption from the timer function 12. Either of these methods may be employed as long as they attain the above functions.

Next, a description will be made of a power saving effect of a feature of the embodiment that the waiting times 4*b* are set so as to vary reversely to the manner of variation of the luminance 3*b* (power consumption) to be determined and output at step S1.

Figure 4:
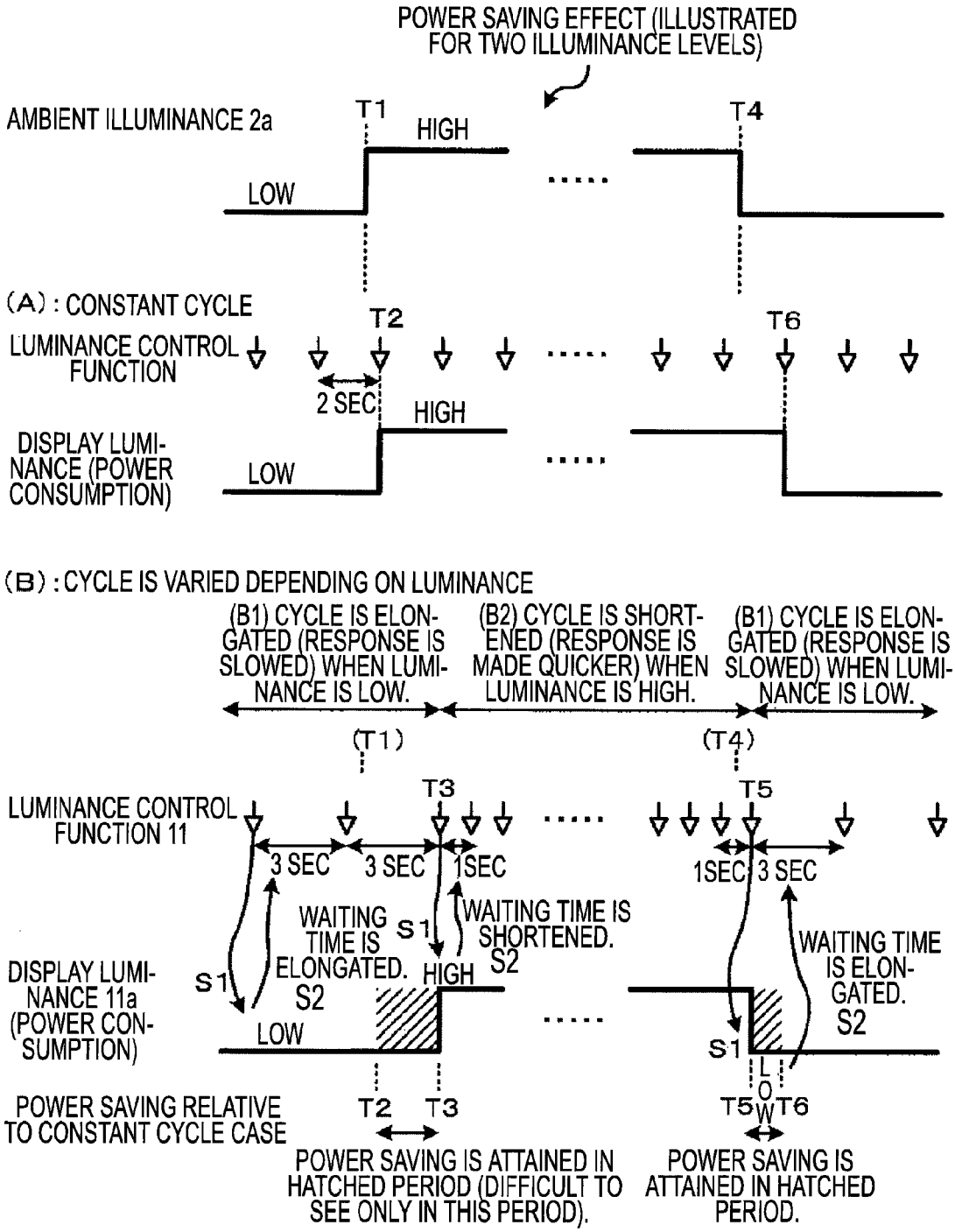
FIG. 4 is an exemplary timing chart illustrating a power saving effect of the electronic apparatus 100 according to the embodiment of the invention.

FIG. 4 is a timing chart illustrating a power saving effect of the electronic apparatus 100 according to the embodiment of the invention through a comparison with a related case. For the sake of simplicity, in this example, it is assumed that the ambient illuminance varies between two levels (high and low).

Assume that the ambient illuminance varies "low" to "high" at time T1 and varies from "high" to "low" at time T4.

FIG. 4, Section (A)

FIG. 4, section (A) shows how the display luminance (power consumption) varies when the ambient illuminance 2*a* varies in the above-mentioned manner in the case where a luminance control function is performed which has a constant cycle (assumed to be 2 sec). Naturally, the variation of the ambient illuminance 2*a* is not synchronized with the activation timing of the luminance control function having the cycle of 2 sec. It is assumed that the illuminance/luminance table is the same as the illuminance/luminance table 3 of the invention.

At each activation time point that precedes an activation time point T2 by more than 2 sec, the luminance control function reads ambient illuminance 2*a* being low and makes the display luminance low.

At time T2 which is the first activation time point after time T1 when the ambient illuminance varies from "low" to "high," the luminance control function reads ambient illuminance 2*a* being high and makes the display luminance high. Therefore, the power consumption of the display module 6 is kept high after time T2. At each activation time point (occurring every 2 sec) after time T2, the luminance control function reads ambient illuminance 2*a* being high and makes the display luminance high.

At time T6 which is the first activation time point after time T4 when the ambient illuminance varies from "high" to "low," the luminance control function reads ambient illuminance 2*a* being low and makes the display luminance low. Therefore, the power consumption of the display module 6 is kept low after time T6.

FIG. 4, Section (B)

Embodiment

FIG. 4, section (B) shows how the display luminance 11*a* (power consumption) varies when the ambient illuminance 2*a* varies in the above-mentioned manner in the case where the luminance control function 11 according to the invention is performed whose cycle is variable (1 to 3 sec). Naturally, the variation of the ambient illuminance 2*a* is not synchronized with the activation timing of the luminance control function 11 whose cycle is variable (1 to 3 sec).

In this embodiment, in a state that the display luminance (power consumption) is low (indicated by symbol B1), the waiting time (approximately equal to the cycle) of the luminance control function 11 is set long (3 sec) to maintain the low power consumption state as long as possible, that is, to delay, as much as possible, a time point of setting the display luminance (power consumption) high in response to a later variation to "high" of the ambient illuminance 2*a*.

In a state that the display luminance (power consumption) is high (indicated by symbol B2), the waiting time (approximately equal to the cycle) of the luminance control function 11 is set short (1 sec) to set the display luminance (power consumption) low as early as possible in response to a later variation to "low" of the ambient illuminance 2*a*.

Next, a more detailed description will be made. At each activation time point that precedes an activation time point T3 by more than 3 sec, the luminance control function 11 reads ambient illuminance 2*a* being low and sets the display luminance 11*a* (power consumption) low (step S1 in FIG. 3). In this case, the luminance control function 11 reads a corresponding waiting time 4*b* of 3 sec from the luminance/waiting time table 4 and sets it in the timer function 12 (step S2). As a result, the response speed is slowed in preparation for a later variation to "high" of the ambient illuminance 2*a*.

Therefore, in this state, the cycle of 3 sec is maintained until time T3 which is the first activation time point after time T1 when the ambient illuminance 2*a* varies from "low" to "high." Time T3 is later than time T2 which is the activation time point of the case of FIG. 4, section (A) (cycle: 2 sec). Naturally, because of the asynchronous operations, time T3 may sometimes be earlier than time T2. However, on average, time T3 is later than time T2.

The luminance control function 11 reads ambient illuminance 2*a* being high at time T3 and sets the display luminance high (step S1). From time T3 onward, the power consumption of the display module 6 is kept high. However, the power is saved in the hatched period between time T2 and time T3 relative to the case of FIG. 4, section (A).

On the other hand, in this period, since the delay from time T1 when the ambient illuminance 2*a* changes to "high" to time T3 when the display luminance is set to an optimum value is increased, the screen becomes difficult to see. However, this is only an instant and is not problematic.

At time T3, the luminance control function 11 sets the display luminance high (step S1), reads a waiting time 4*b* (1 sec) corresponding to the high display luminance from the luminance/waiting time table 4, and sets it in the timer function 12 (step S2). As a result, the response speed is increased in preparation for a later variation to "low" of the ambient illuminance 2*a*.

Therefore, in this state, the cycle of 1 sec is maintained until time T5 which is the first activation time point after time T4 when the ambient illuminance 2*a* varies from "high" to "low." Time T5 is earlier than time T6 which is the activation time point of the case of FIG. 4, section (A) (cycle: 2 sec). Naturally, because of the asynchronous operations, time T5 may sometimes be later than time T6. However, on average, time T5 is earlier than time T6.

The luminance control function 11 reads ambient illuminance 2*a* being low at time T5 and sets the display luminance low (step S1). From time T5 onward, the power consumption of the display module 6 is kept low. As a result, the power is saved in the hatched period between time T5 and time T6 relative to the case of FIG. 4, section (A).

At time T5, the luminance control function 11 sets the display luminance low (step S1), reads a waiting time 4*b* (3 sec) corresponding to the low display luminance from the luminance/waiting time table 4, and sets it in the timer function 12 (step S2). As a result, from time T5 onward, the cycle of the luminance control function 11 is kept equal to about 3 sec and the response speed is kept low.

As described above, the embodiment of the invention provides a power saving effect when the ambient illuminance varies. Since in general the ambient illuminance varies all the time, attaining a power saving effect every variation time point provides a great advantage. Where the ambient illuminance does not vary, the embodiment provides the same levels of power consumption and viewability as the conventional case does. Although the optimization of the light-emission luminance of the display module is somewhat delayed when the ambient illuminance increases, it is just an instant and does not cause a problem relating to the viewability.

Although in the embodiment of the invention the display module 3 is an LCD module and the luminance of its backlight is controlled, in self-emission displays such as organic EL displays the luminance and the power consumption may be controlled by controlling the supply voltage, for example.

The electronic apparatus 100 according to the invention can be applied to cell phones, PHS phones, game machines, cameras, etc.

What is claimed is:

1. An electronic apparatus comprising:

a luminance adjustable display module;

an illuminance sensor configured to detect illuminance around the electronic apparatus; and a controller configured to:

read the illuminance from the illuminance sensor;

determine luminance corresponding to the illuminance;

control the luminance adjustable display module to set luminance to the determined luminance; and set a waiting time based on the determined luminance, the waiting time being a time to a next time point of illuminance reading and luminance control, wherein the controller is configured to set the waiting time to a shorter period of time when the determined luminance is at a high level and to set the waiting time to a longer period of time which is greater than the shorter period of time when the determined luminance is at a low level which is less than the high level.

2. The electronic apparatus of claim 1, further comprising table configured to store waiting times wherein the waiting times are set so as to be shorter as the luminance becomes higher and longer as the luminance becomes lower, wherein the controller is configured to read a waiting time corresponding to the determined luminance from the table and to set the read waiting time as the waiting time to the next time point of illuminance reading and luminance control.

3. The electronic apparatus of claim 1, wherein the luminance adjustable display module is adjusted by controlling luminance of a backlight of the luminance adjustable display module.

* * * * *